United States Patent [19]

Boisrayon et al.

[11] 3,969,903

[45] July 20, 1976

[54] UNDERWATER ESCAPE APPARATUS

[75] Inventors: Gérald Marc Albert Boisrayon, Le-Beausset; Gilbert Marius Henri Martin, La Seyne-sur-Mer; Edmond G. Fagnen, Toulon, all of France

[73] Assignee: Etat Francais, Paris Armies, France

[22] Filed: May 20, 1975

[21] Appl. No.: 579,215

[30] Foreign Application Priority Data

Aug. 22, 1974 France ..... 74.28787

[52] U.S. Cl. ..... 61/70; 114/209

[51] Int. Cl.[2] ..... B63C 9/00

[58] Field of Search ..... 61/69, 69 A, 70, 71; 114/16 E, 209

[56] References Cited

UNITED STATES PATENTS

| | | | |
|---|---|---|---|
| 3,495,413 | 2/1970 | Pinto | 61/69 R |
| 3,902,327 | 9/1975 | Guillerm et al. | 61/70 |

*Primary Examiner*—Paul R. Gilliam
*Assistant Examiner*—Alex Grosz
*Attorney, Agent, or Firm*—Larson, Taylor & Hinds

[57] ABSTRACT

Underwater escape apparatus, intended for use in conjunction with an underwater escape suit provided with means for imparting to the suit an ascent velocity to permit escape from an underwater location to the water surface, comprises, on the one hand, a parachute folded within a container and provided with a pressure responsive member such as a piston, and, on the other hand, a pressure gas cylinder connected to the container by a flexible conduit communicating with the face of the piston opposite the parachute, and equipped with obturating means and means for automatically triggering opening thereof as soon as the immersion depth becomes smaller than a predetermined threshold. Preferably the apparatus includes means for setting the automatic opening device only after the immersion depth has exceeded a predetermined limit beyond which there would be a danger of gaseous embolism taking place during the ascent. The container containing the parachute and the device for automatic triggering of opening of the latter are separately secured to the escape suit, and the setting depth and the depth of automatic triggering are regulatable independently of each other.

8 Claims, 4 Drawing Figures

UNDERWATER ESCAPE APPARATUS

FIELD OF THE INVENTION

This invention relates to underwater escape apparatus, particularly individual underwater escape devices for use in conjunction with an underwater escape suit.

BACKGROUND AND SUMMARY

In commonly assigned copending application Ser. No. 474,070, filed May 28, 1974, now U.S. Pat. No. 3,902,327, for "UNDERWATER ESCAPE APPARATUS", there was described apparatus and procedure for the individual escape of the members of the crew of a submarine in distress at considerable depth, the escape being from a flooding chamber which they enter individually after having donned a suit and a hood. In accordance with that apparatus and procedure, when the depth of immersion is greater than 180 meters, in order to prevent the gaseous embolism each submariner is equipped with a device comprising a parachute for decelerating his velocity in the last part of the ascent to the surface. It is the basic object of the instant invention to provide an improved apparatus for use in such escape procedures, which apparatus overcomes some disadvantages of the apparatus disclosed in this previous application.

In the apparatus of the previous application, automatic opening of the parachute is achieved mechanically due to opening of a container which is fast with the triggering device. It is one of the objects of the instant invention to disassociate, on the one hand, the container containing the parachute and, on the other hand, the device for automatic triggering of opening of the latter, in such manner that it is possible to secure them separately to the submariner's suit, thereby obtaining a less cumbersome apparatus.

The apparatus disclosed in the previous application includes a single spring, the force of which determines simultaneously the depth of immersion at which the device is set and the depth at which the parachute is automatically launched. It is a further object of the instant invention to disassociate the means permitting regulation of the setting depth and the depth of automatic triggering of parachute opening, in such manner that it is possible to regulate these arrangements independently of each other, and such that it is possible to determine the setting depth by means which are more precise than a spring, the characteristics of which may vary in course of time, thereby involving a risk of producing a setting error which might result in death due to embolism.

In general the objects of the present invention are achieved by means of apparatus for use in keeping with the procedures of the previously mentioned earlier application, which apparatus is adapted to be secured to an individual escape suit and comprises, on the one hand, an ascent retarder such as a parachute folded within a container, which may be open, and provided with a pressure responsive member such as a piston, and, on the other hand, a pressure gas cylinder connected to the container by a flexible conduit communicating with the face of the piston opposite the parachute, and equipped with obturating means and means for automatically triggering opening thereof as soon as the immersion depth becomes smaller than a predetermined threshold depth, for example a threshold depth of 60 meters.

Apparatus in accordance with the invention comprises, furthermore, means for setting the automatic opening device of the obturating means only after the immersion depth has exceeded a predetermined limit beyond which there would be a danger of gaseous embolism taking place during the ascent, for example, if the immersion depth has exceeded 180 meters.

Apparatus in accordance with the invention comprises, in a preferred arrangement, obturating means constituted by a cover or cap disposed opposite a striker fast with a piston adapted to slide, under the action of a spring, in a fixed cylinder, which cylinder includes means for locking the piston, the locking means being automatically moved away to free the piston and striker when the immersion depth becomes less than the said predetermined threshold. The locking means preferably comprise balls lodged in orifices recessed through the wall of the fixed cylinder, which balls engage on the one hand in a peripheral groove formed in the piston carrying the striker, and cooperate on the other hand with the wall of a mobile cylinder which is coaxial to the fixed cylinder and surrounds it. The mobile cylinder is fast with a piston which is displaceable in a housing communicating with the exterior of the apparatus via orifices, the piston being maintained in abutment with a diaphragm disposed transversely of the housing by a spring opposing the water pressure thrust, in a position wherein the balls are maintained by the mobile cylinder in the striker locking position.

The resistance of the diaphragm to water pressure is selected to be such that the diaphragm will be ruptured as soon as the immersion depth exceeds the upper limit beyond which the device requires to be set. Rupture of the diaphragm frees the mobile cylinder which, in turn, frees the striker locking balls as soon as the immersion depth becomes smaller than the threshold depth at which the parachute is required to open. Preferably the rupturable diaphragm is engaged at its periphery in the walls of the housing, and is disposed between two rigid plates, for example between two discs, the surface of each disc being slightly smaller than that of the diaphragm, in such manner that the diaphragm is not deformed in flexure before rupturing.

The result achieved by the invention is an improved apparatus for use in keeping with the procedures mentioned in the previously mentioned prior application. The improved apparatus has the advantage that the immersion limit beyond which the device is set (cocked) is obtained with the aid of a diaphragm rupturable under the water pressure, thereby making it possible to determine the threshold with a high degree of precision and a high degree of safety, without risk of modification thereof due to modifications in the properties of a spring in course of time.

A further advantage of apparatus in accordance with the instant invention resides in the fact that the parachute opening threshold is determined by means independent of those determining the setting threshold.

Still a further advantage of apparatus in accordance with the instant invention resides in the fact that the parachute container may be made separate from the device for automatically triggering opening of the parachute, thereby making it possible to fix the parachute container to the bottom of a leg of the escape suit, in such manner that during ascent deceleration the wearer of the suit remains in a vertical position, while at the same time making it possible to secure the pressure gas cylinder and the obturating means at another location on the escape suit where it would be less troublesome, for example, in a lateral "pocket".

There follows a description of a preferred embodiment of the invention, with reference to the accompanying drawings which show, without being limiting, an example of a preferred embodiment of the invention.

DESCRIPTION OF A PREFERRED EMBODIMENT

Figure 1:
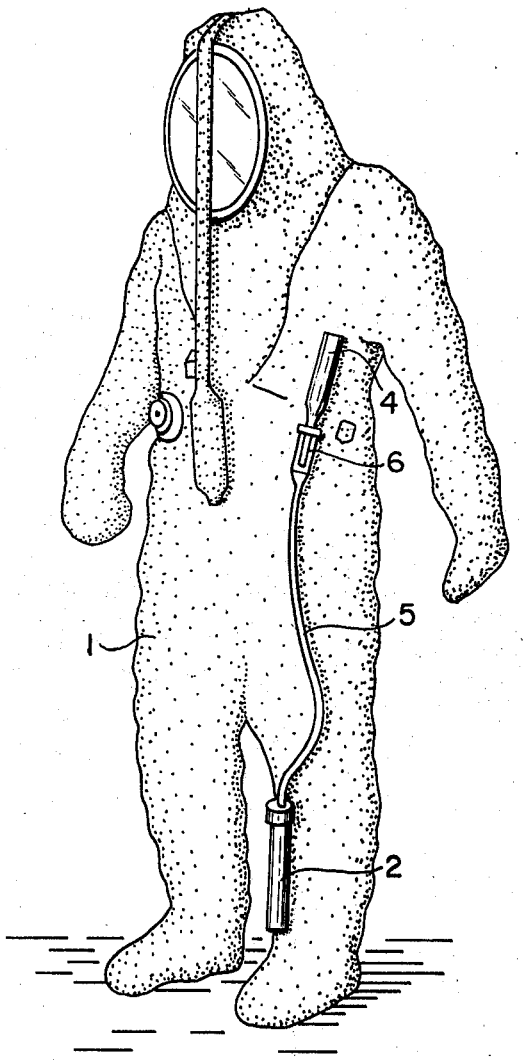
FIG. 1 is a general view of apparatus according to the invention, secured on an escape suit.

FIG. 1 shows a man in an escape suit 1 permitting individual evacuation of the members of the crew of a submarine in distress, for example, or the occupants of a fluid-tight, nonpressurized compartment situated under water. The suit 1 is equipped, in known manner, with means imparting to the wearer thereof a thrust and an ascent velocity, and means enabling him to breathe during the ascent, which lasts several minutes.

Apparatus in accordance with the invention is secured to the exterior of the suit. It comprises on the one hand a container 2 secured to the lower end of a leg and in which is disposed a folded parachute 3, and on the other hand a cylinder 4 containing pressure gas, for example a carbon dioxide cylinder, disposed for example in a lateral pocket of the suit. The cylinder 4 is connected to the container 2 by a flexible conduit 5. It is equipped with obturating means 6 adapted to be pierced and automatically establishing communication between the cylinder 4 and the container 2 when the immersion depth falls below a predetermined threshold, for example below 60 meters, thereby expelling the parachute 3 out of the container 2, the parachute thereafter unfolding to retard the ascent of the user.

Figure 2:
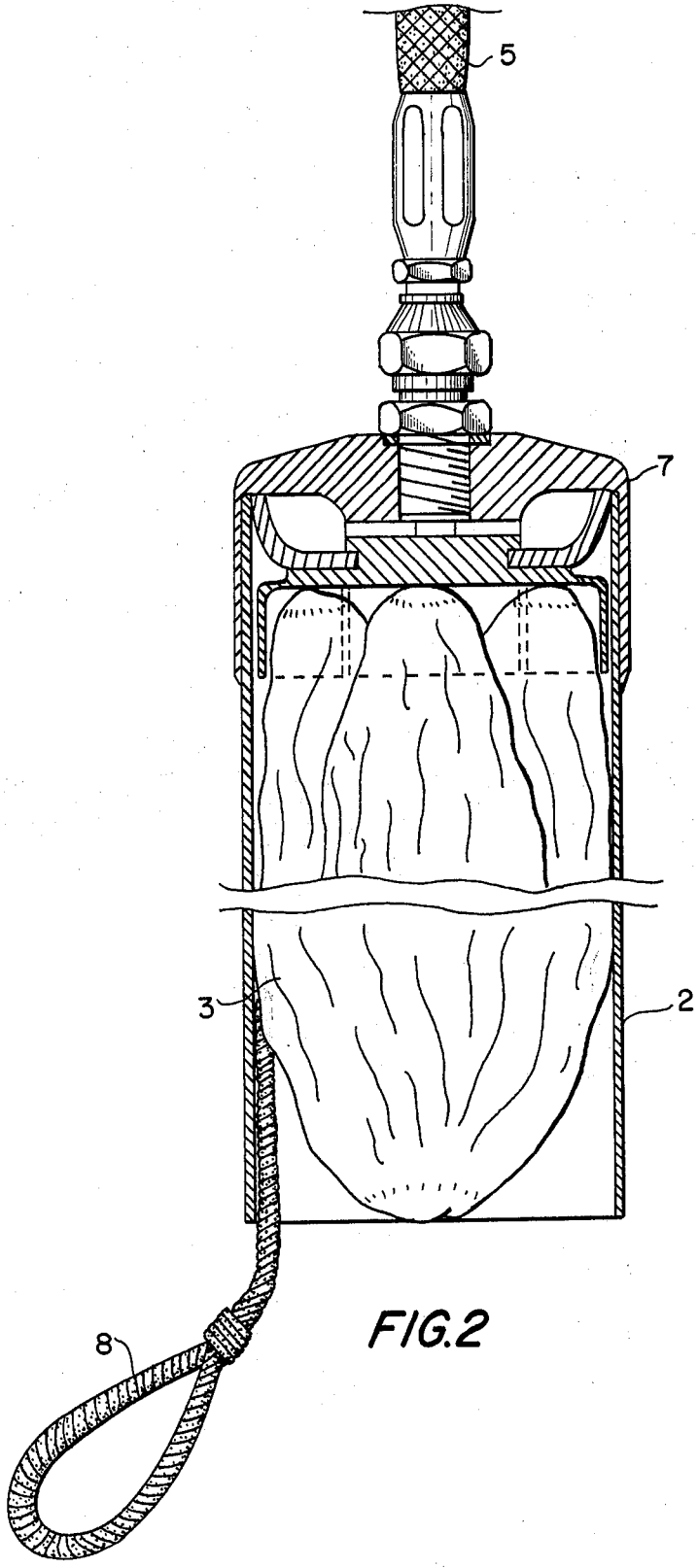
FIG. 2 is a longitudinal section through the parachute container.

FIG. 2 shows the cylindrical container 2, open at the lower end and containing a folded parachute 3. The container comprises, at the other end, a piston 7 above which debouches the flexible conduit 5. When the obturating means 6 for the pressure gas cylinder is open, the gas pressure urges the piston 7 and expels the parachute from the container. A cord 8 permits manual extraction of the parachute from the container.

Figure 3:
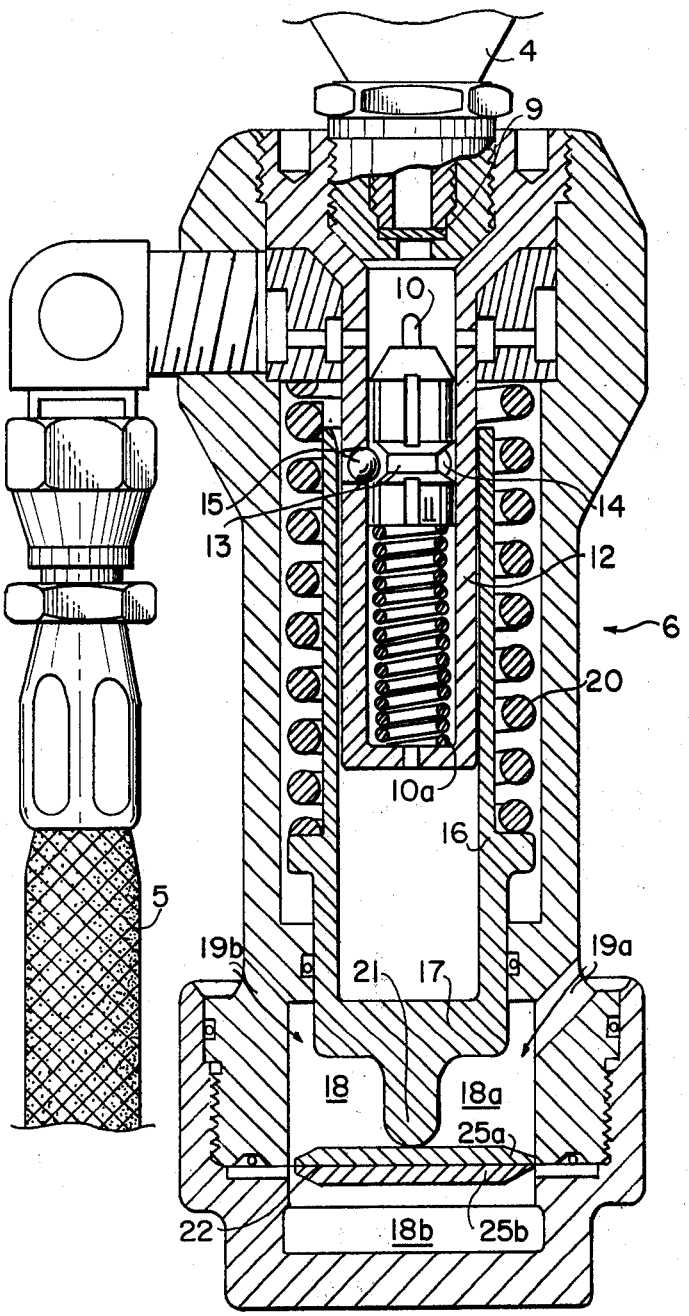
FIG. 3 is a longitudinal section through the obturating means for the pressure gas cylinder, showing the striker device and related controls in the locked position.
Figure 4:
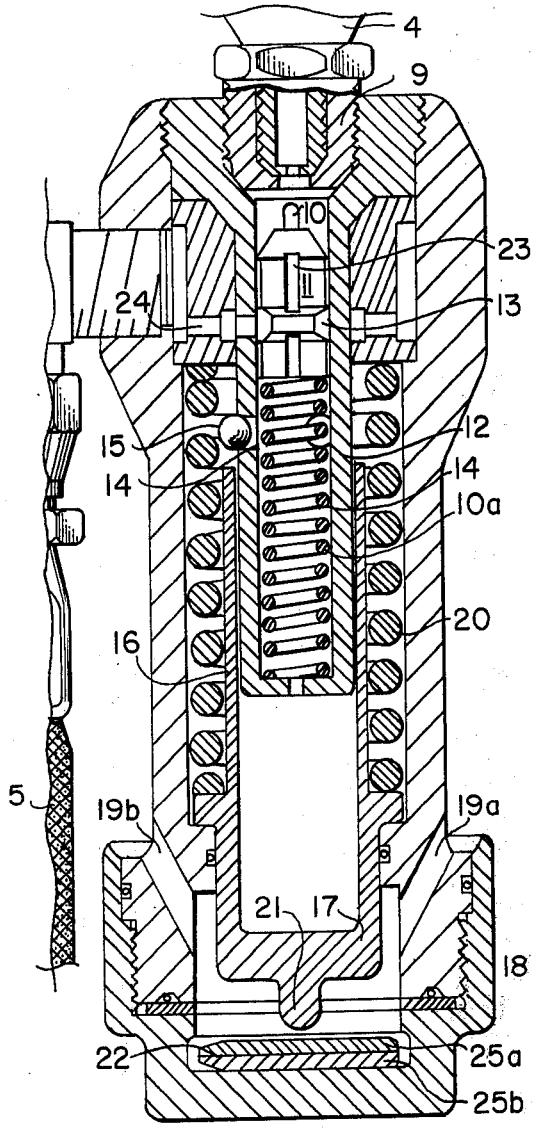
FIG. 4 is a section similar to that of FIG. 3, after unlocking and piercing of the obturator has taken place.

FIGS. 3 and 4 show, in section, the assembly comprising the obturating means 6 adapted to be pierced, and screwed onto a pressure gas cylinder 4. In these two figures, like elements have been given the same reference numerals. Reference numeral 9 designates a cover or cap for obturating the cylinder 4. The cap is disposed opposite a striker 10 taking the form of a plunger carried by a piston 11 sliding in a fixed cylinder 12.

The piston 11 is formed with a peripheral groove 13. The cylinder 12 is formed with orifices 14 (for example three orifices) in which are disposed balls 15 for locking the striker, which tends to be projected against the cap 9 by a spring 10*a*.

FIG. 3 shows the balls 15 maintained engaged in the groove 13 by a mobile cylinder 16, coaxial with the cylinder 12 and surrounding the latter with an extremely small clearance.

The cylinder 16 is fast with a piston 17 extending into a housing 18 communicating with the sea by orifices 19*a* and 19*b*. The pressure of the water contained in the housing 18 urges the piston 17 upwardly, thereby compressing a spring 20 which exerts on the piston 17 a force opposing the water pressure. The piston 17 is fast with a rod 21 bearing on a rupturable diaphragm 22 disposed transversely of the housing 18.

FIG. 3 shows the diaphragm 22 unruptured. In this position, the cylinder 16 is prevented from descending sufficiently to liberate the locking balls 15. The striker 10 is thus not able to travel, and the parachute is not launched.

The diaphragm 22 divides the housing 18 into two compartments, one compartment 18*a* in which the hydrostatic pressure is exerted, and a second fluid-tight compartment 18*b*. The diaphragm 22 is thus subjected to the hydrostatic pressure on a single face. The resistance of the diaphragm is selected to be such that it is ruptured when the immersion depth exceeds a limit, for example 180 meters, this limit corresponding to that beyond which accidents due to gaseous embolism might take place.

FIG. 4 shows the diaphragm 22 after rupture. The piston 17 and the cylinder 16 are then free to travel. For as long as the immersion remains considerable, the action of the water pressure on the piston 17 compresses the spring 20, and the cylinder 16 maintains the balls 15 in the striker locking position. When the immersion depth falls below a limit depending on the force of the springs 20, the mobile cylinder 16 passes into a position in which the balls 15 are liberated. The force of the spring 20 is selected to produce the result that unlocking takes place during ascent at a depth of the order of 60 meters. The piston 11 is then projected against the cap 9 which is perforated by the striker 10. The pressure of the gas container in the cylinder 4 urges the piston 11, and the gas flows through the peripheral grooves 23 toward the groove 13, which communicates with a duct 24 conveying the compressed gas toward the flexible tube 5.

The diaphragm 22 may comprise a bronze/beryllium pellet or "pastille", the thickness of which is 0.02 mm and the periphery of which is engaged in the walls of the housing 18. The pellet is disposed between two cross-bracing members 25*a* and 25*b* assembled by rivets. If the pellet 22 is circular, the cross-bracing members 25*a* and 25*b* have a diameter slightly smaller than that of the pellet. The cross-bracing members serve to stiffen the pellet 22 in order to prevent it from flexing. Rupture of the diaphragm 22 is effected by shearing between the periphery of the cross-bracing members and the engagement arrangement, thereby making it possible to determine with precision the pressure at which such rupture takes place.

It will be readily apparent that, without departing from the scope and spirit of the invention, various parts of the device described by way of example could be replaced by equivalent parts such as are known to persons skilled in the art.

We claim:

1. Underwater escape apparatus intended for use in conjunction with an underwater escape suit provided with means for imparting to the suit an ascent velocity to permit escape from an underwater location to the water surface, said apparatus comprising a container adapted to be fixed to the suit, ascent retarder means normally inside said container but movable from said container to retard the ascent of a suit to which the container is fixed, pressure responsive means carried by said container for, when pressurized, moving said ascent retarder means from said container, a pressure gas cylinder adapted to be carried by the suit and connected to said container by flexible conduit for pressurizing said pressure responsive means so as to effect movement of said ascent retarder means from said container, obturating means normally closing off fluid communication through said conduit between said container and said gas cylinder, and water depth responsive trigger means adapted to be carried by the suit for automatically triggering opening of said obturating means as soon as immersion depth becomes smaller than a predetermined threshold depth, whereby to effect operation of said ascent retarder means and hence reduction of ascent velocity during ascent from said threshold depth.

2. Apparatus as claimed in claim 1 wherein said ascent retarder means comprises a folded parachute in said container, and said pressure responsive means comprises a piston carried by said container.

3. Apparatus as claimed in claim 2 further comprising setting means for arming said trigger means only after the immersion depth has exceeded a predetermined value, whereby to permit said automatic opening of said obturating means only after the immersion depth has exceeded said predetermined value.

4. Apparatus as claimed in claim 2 wherein said obturating means comprises an obturating member closing said pressure gas cylinder, and said trigger means comprises a spring loaded striker for piercing said obturating member, a fixed cylinder in which said striker is slidably disposed opposite said obturating member, means for normally locking said striker in said fixed cylinder in a spring loaded position spaced from said obturating member, and means for unlocking said locking means when the immersion depth becomes less than said threshold depth, whereby to release said striker to pierce said obturating member and establish fluid communication between said pressure gas cylinder and said pressure responsive means carried by said container.

5. Apparatus according to claim 4 wherein said locking means comprise balls lodged in orifices through the wall of said fixed cylinder, said balls engaging on the one hand in a peripheral groove formed in said striker, and cooperating on the other hand with the wall of a mobile cylinder coaxial with and surrounding said fixed cylinder, such that the wall of said mobile cylinder forces said balls into engagement with the peripheral groove in said striker to lock said striker in its spring loaded position so long as the mobile cylinder holds said balls in engagement with said peripheral groove.

6. Apparatus according to claim 5 further comprising a piston to which said mobile cylinder is fixed, said piston being displaceable in a housing communicating with the exterior of the apparatus via orifices, a diaphragm disposed transversely of said housing and opposite said piston, the arrangement being such that the opposing faces of said piston and said diaphragm are exposed to water pressure existing in said housing by virtue of the orifices communicating said housing with the exterior of the apparatus, a spring urging said piston into abutment with said diaphragm in opposition to the water pressure thrust on said piston in said housing, the piston being constructed and arranged such that said balls are maintained in striker locking position when said piston is in abutment with said diaphragm.

7. Apparatus according to claim 6 wherein the strength of said diaphragm is such that it is ruptured when the immersion depth exceeds a predetermined limit, thereby liberating said mobile cylinder to in turn free said striker locking balls as soon as the immersion depth thereafter becomes less than said threshold depth such that said spring moves said piston in opposition to water pressure in said housing to a position beyond its position of abutment with said diaphragm, and hence beyond its position wherein said balls are maintained by said mobile cylinder in the striker locking position.

8. Apparatus according to claim 7 wherein said rupturable diaphragm is engaged at its periphery in the walls of said housing, and is disposed between two rigid plates, the surface of which plates is slightly smaller than that of said diaphragm.

* * * * *